US008915629B2

(12) United States Patent
Madireddi et al.

(10) Patent No.: US 8,915,629 B2
(45) Date of Patent: Dec. 23, 2014

(54) LIGHT FIXTURE FOR A MERCHANDISER

(71) Applicant: Hussmann Corporation, St. Louis, MO (US)

(72) Inventors: Sesha Madireddi, St. Charles, MO (US); Daniel Schnur, Florissant, MO (US); Nick Yurek, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 157 days.

(21) Appl. No.: 13/797,030

(22) Filed: Mar. 12, 2013

(65) Prior Publication Data

US 2014/0168953 A1 Jun. 19, 2014

Related U.S. Application Data

(60) Provisional application No. 61/739,292, filed on Dec. 19, 2012.

(51) Int. Cl.
*F21V 21/00* (2006.01)
*F21V 21/14* (2006.01)

(52) U.S. Cl.
CPC ..... *F21V 21/14* (2013.01)
USPC ..... 362/396; 362/125; 362/427; 362/449

(58) Field of Classification Search
CPC ..... A47F 3/001; F21V 21/14
USPC ..... 362/396, 125, 427, 449
See application file for complete search history.

(56) References Cited

U.S. PATENT DOCUMENTS

| | | | | |
|---|---|---|---|---|
| 2,103,013 | A | | 12/1937 | Nirdlinger |
| 2,905,806 | A | | 9/1959 | Tunney |
| 3,219,812 | A | | 11/1965 | Turner |
| 4,626,975 | A | | 12/1986 | Miletich |
| 4,734,838 | A | | 3/1988 | Pike |
| 4,849,864 | A | | 7/1989 | Forrest |
| 4,994,943 | A | | 2/1991 | Aspenwall |
| 5,023,755 | A | | 6/1991 | Rosenberg |
| 5,126,928 | A | | 6/1992 | Hughes |
| 5,195,823 | A | | 3/1993 | Sidabras |
| 5,235,500 | A | | 8/1993 | Sapper |
| 5,337,987 | A | * | 8/1994 | Sawatsky ..... 248/231.81 |
| 5,481,441 | A | | 1/1996 | Stevens |
| 5,548,496 | A | | 8/1996 | Hart et al. |
| 5,564,815 | A | | 10/1996 | Littman et al. |
| 5,593,224 | A | | 1/1997 | Kunkel et al. |
| 5,653,412 | A | | 8/1997 | Martorano et al. |
| 6,036,337 | A | | 3/2000 | Belfer |
| 6,039,457 | A | | 3/2000 | O'Neal |
| 6,224,242 | B1 | | 5/2001 | Giraud et al. |
| 6,280,056 | B1 | | 8/2001 | Dolan et al. |
| 6,347,776 | B1 | | 2/2002 | Chuang |
| 6,607,285 | B2 | | 8/2003 | Citron et al. |
| 6,726,348 | B2 | | 4/2004 | Gloisten |
| 6,893,139 | B2 | | 5/2005 | Cercone et al. |
| 7,111,966 | B1 | | 9/2006 | Jenkins |

(Continued)

*Primary Examiner* — Vip Patel
(74) *Attorney, Agent, or Firm* — Michael Best & Friedrich LLP

(57) ABSTRACT

A light fixture assembly including a bracket defined by an arcuate base and a clip dovetailed to the bracket within the base. The clip and the bracket define cooperative serrations to permit rotatable adjustment of the clip relative to the base about a longitudinal axis to provide different orientations for a light source within the case.

20 Claims, 4 Drawing Sheets

(56) References Cited

U.S. PATENT DOCUMENTS

| | | | | |
|---|---|---|---|---|
| 7,152,997 | B1 | 12/2006 | Kovacik et al. | |
| 7,234,846 | B2 | 6/2007 | Chen | |
| 7,510,302 | B1 | 3/2009 | Curtis et al. | |
| 7,517,119 | B2 | 4/2009 | Kaeser et al. | |
| 7,530,705 | B2 | 5/2009 | Czech et al. | |
| 7,566,151 | B2 | 7/2009 | Whelan et al. | |
| 7,568,812 | B1 | 8/2009 | Kumthampinij et al. | |
| 7,686,483 | B1 | 3/2010 | Aubrey | |
| 7,794,113 | B2 | 9/2010 | Lee | |
| 7,874,709 | B1 | 1/2011 | Beadle | |
| 7,963,058 | B2 | 6/2011 | Kinzel et al. | |
| 8,002,425 | B2 | 8/2011 | Russo et al. | |
| 8,075,163 | B2 | 12/2011 | Xiao et al. | |
| 8,162,277 | B2 | 4/2012 | Russell | |
| 8,162,502 | B1 | 4/2012 | Zandro | |
| 8,226,278 | B2 | 7/2012 | Ward et al. | |
| 8,360,597 | B1 * | 1/2013 | Hanchett | 362/190 |
| 2007/0025110 | A1 | 2/2007 | Langlois et al. | |
| 2009/0219720 | A1 * | 9/2009 | Reed | 362/308 |
| 2010/0157602 | A1 | 6/2010 | Nichols | |

* cited by examiner 100
102
104
A
Front 100
102
104
A
A
Left 100
102
104
Top 100
102
104
Trimetric

LIGHT FIXTURE FOR A MERCHANDISER

BACKGROUND

The present invention relates to a light fixture for a merchandiser, and more particularly to an adjustable light fixture.

Conventional light fixtures generally include a frame or bracket that attach to a portion of a merchandiser (e.g., shelf, mullion, canopy) and that support a light (e.g., LEDs) for illuminating a display area of the merchandiser. Existing light fixtures are often secured to the merchandiser using a magnet or a fastener (e.g., screw or bolt). Typically, conventional light fixtures must be replaced with another light fixture to modify the angle of illumination of the light or other aspects of the light.

SUMMARY

In one construction, the invention provides a light fixture assembly including a bracket defined by an arcuate base and a clip dovetailed to the bracket within the base. The clip and the bracket define cooperative serrations to permit rotatable adjustment of the clip relative to the base about a longitudinal axis to provide different orientations for a light source within the case.

In another construction, the invention provides a light fixture including a bracket including a truncated arcuate-shaped base that has an arcuate channel disposed in an inner arcuate surface of the base and extending from one end of the base to another end of the base. The light fixture also includes a clip that is shaped to couple a light source to the light fixture and that includes a guide member coupled to the bracket within the channel. The clip is rotatable up to 180° relative to the bracket within the channel to arcuately adjust the light source to provide different orientations for the light source.

In another construction, the invention provides a light fixture for a merchandiser. The light fixture includes an arcuate bracket having a first surface and a track. The first surface includes first serrations on opposite sides of the track. The light fixture also includes an arcuate clip including a light attachment and a guide member. The light attachment includes a second surface extending on opposite sides of the guide member and has second serrations. The guide member is movably received within the track, and the first and second serrations cooperate in order to adjust the clip relative to bracket.

In another construction, the invention provides a merchandiser including a case that defines a product display area and that has at least one of a canopy disposed over the product display area and a shelf positioned in the product display area. The merchandiser also includes a light fixture that is coupled to at least one of the canopy and the shelf. The light fixture includes a bracket that is defined by an arcuate base and a clip dovetailed to the bracket within the base. The clip and the bracket define cooperative serrations to permit rotatable adjustment of the clip relative to the base about a longitudinal axis defined by the arcuate base to provide different orientations for a light source within the case.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
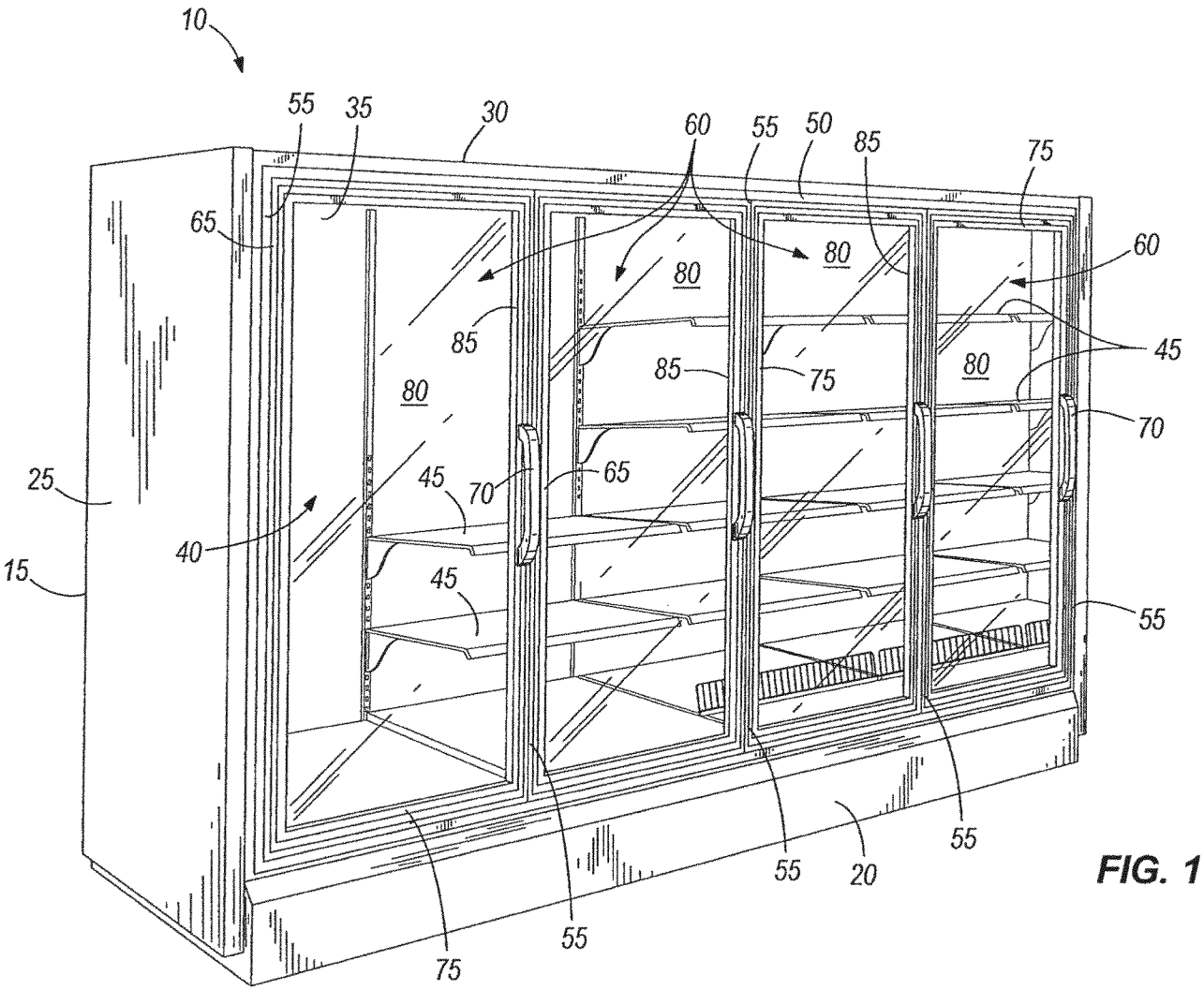
FIG. 1 illustrates a perspective view of a merchandiser having a light assembly.
Figures 2A, 2B, 2C, 2D:
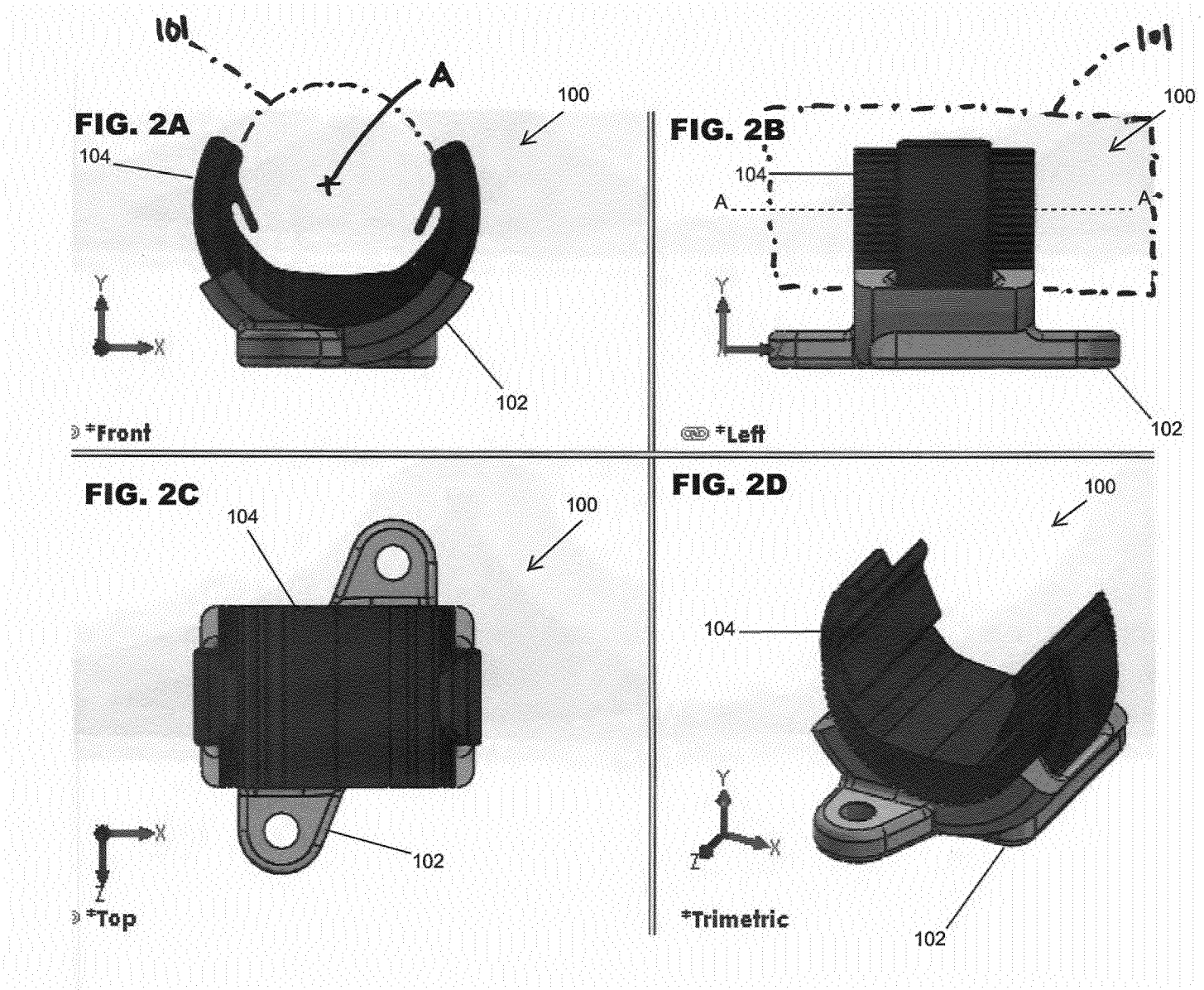
FIG. 2A illustrates a front view of a light fixture including a bracket and a clip embodying the invention and supporting the light assembly on the merchandiser.
FIG. 2B illustrates a side view of the light fixture.
FIG. 2C illustrates a top view of the light fixture.
FIG. 2D illustrates a perspective view of the light fixture.

FIG. 1 shows a merchandiser 10 for displaying food product (e.g., frozen food, fresh food, beverages, etc.) available to consumers in a retail setting (e.g., a supermarket or grocery store). The merchandiser 10 includes a case 15 that has a base 20, side walls 25, a case top or canopy 30, and a rear wall 35. At least a portion of a refrigeration system (not shown) can be located within the case 15 to refrigerate the food product. In other constructions, a heating system can be located within the case 15 to heat the food product. The area partially enclosed by the base 20, the side walls 25, the case top 30, and the rear wall 35 defines a product display area 40. The food product is supported on shelves 45 within the product display area 40.

As illustrated, the case 15 includes a frame 50 adjacent a front of the merchandiser 10. FIG. 1 shows that the frame 50 includes vertical mullions 55 that define openings 60, and doors 65 positioned over the openings 60. The openings 60 and the doors 65 are allow access to food product stored in the product display area 40. The mullions 55 are spaced horizontally along the case 15 to provide structural support for the case 15. Each mullion 55 is defined by a structural member that can be formed from a non-metallic or metallic material. A handle 70 is positioned along an edge of each door 65 to move the door 65 between an open position and a closed position. In some constructions, the merchandiser 10 can be provided without doors (e.g., the merchandiser 10 can be an open-air merchandiser).

Each door 65 includes a frame 75 that attaches a translucent member 80 to the door 65 to allow viewing of the food product from outside the case 15. The translucent member 80 can be formed from glass, or alternatively, from other materials that are substantially translucent (e.g., acrylic, etc.).

With reference to FIGS. 1-4D, the product display area 40 is illuminated by one or more light assemblies including light fixtures 100 that support a light source 101 (e.g., fluorescent, LED, etc.). For example, one or more light fixtures 100 can be coupled to the canopy 30 to illuminate the product display area 40 from above. Alternatively or in addition, one or more light fixtures 100 can be coupled to one or more of the shelves 45, the mullions 55, or other parts of the case 15.

Figures 3A, 3B, 3C, 3D:
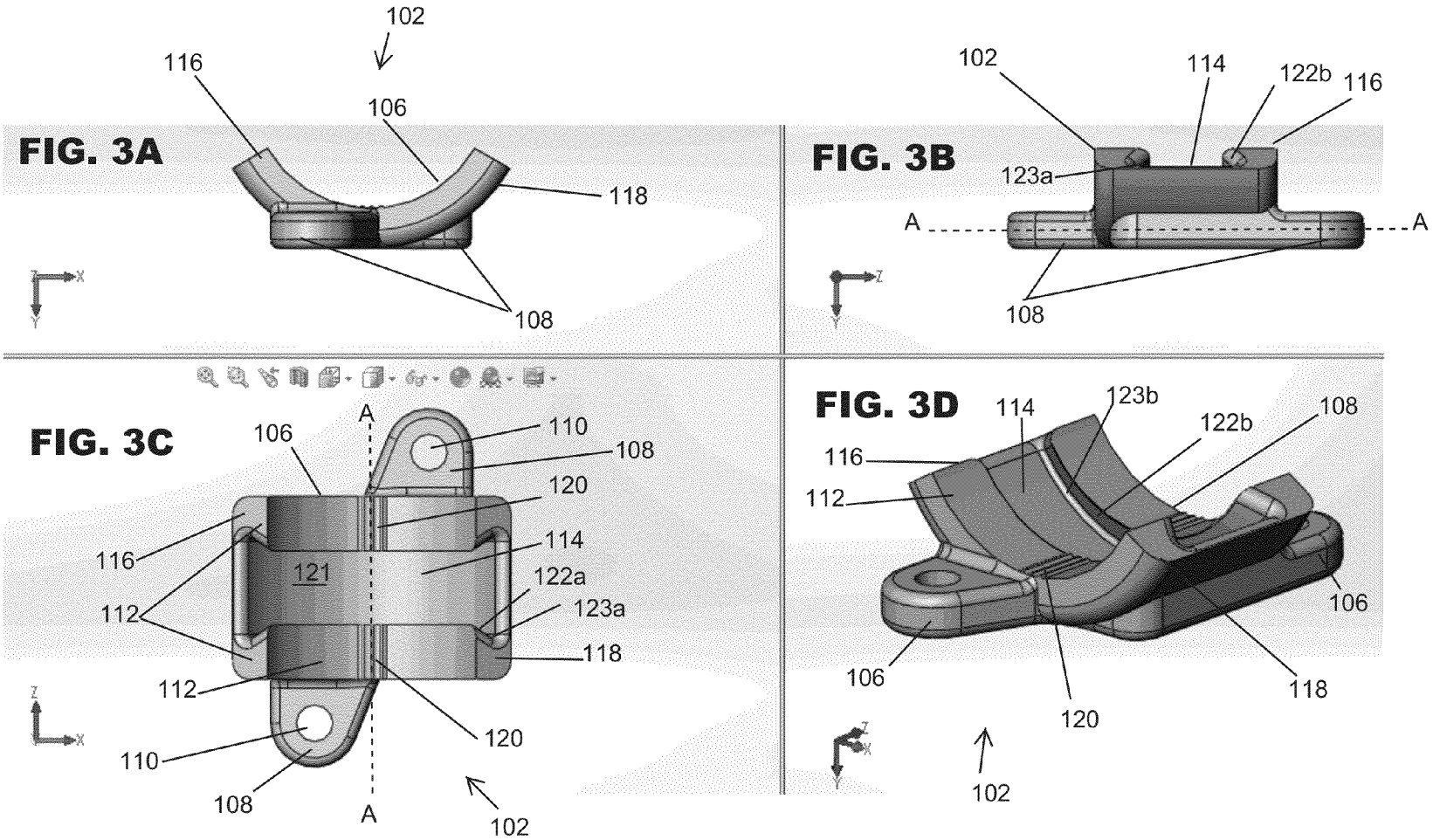
FIG. 3A illustrates a front view of the bracket of FIGS. 2A-2D.
FIG. 3B illustrates a side view of the bracket of FIGS. 2A-2D.
FIG. 3C illustrates a top view of the bracket of FIGS. 2A-2D.
FIG. 3D illustrates a perspective view of the bracket of FIGS. 2A-2D.

FIGS. 2-4 show that the light fixture 100 includes a bracket 102 (FIGS. 3A-3D) and a clip 104 that is adjustable relative to the bracket 102. As illustrated, the bracket 102 and the clip 104 of the light fixture 100 are arcuately shaped, although other mating shapes are possible. The relative dimensions of the bracket 102 and the clip 104 can vary depending on the application (e.g., the track 114 and guide member 128 may be wider or narrower). Also, more than one track 114 and corresponding guide members 128 can be provided.

With reference to FIGS. 3A-3D, the bracket 102 includes a body that has an arcuate portion or base 106 and mounting portions 108 extending from lateral edges of the substantially arcuate portion 106. Each mounting portion 108 includes an aperture 110 that receives a fastener (e.g., a self-tapping screw, bolt, etc.) to attach the bracket 102 to a shelf or wall (not shown) of the merchandiser 10.

The bracket 102 defines an axis A about which the arcuate portion 106 is curved. The arcuate portion 106 has an arcuate surface 112 and a central channel or track 114 that extends between first and second ends 116, 118 of the arcuate portion 106 along the arcuate surface 112 (i.e., along the curvature of the arcuate portion). The arcuate portion 106 also has a plurality of closely spaced first ridges or ribs or serrations 120 disposed midway between the first and second ends 116, 118 extending substantially parallel to the axis A on lateral sides of the track 114. It should be noted that the bracket 102 may include more or less ridges 120 along the surface 112. The track 114 has a recessed surface 121 and first and second sides 122*a*, 122*b* that define first and second recessed grooves 123*a*, 123*b* extending between the first and second ends 116, 118. In the illustrated construction, the track 114 is substantially rectangular in cross-section, although other shapes are possible.

FIGS. 4A-4D illustrate that the clip 104 is defined by a truncated arcuately shaped (e.g., cylindrical) body that can nest in the base 106. The clip 104 has a first end 124 and a second end 126 located arcuately opposite the first end 124. As illustrated, the clip 104 has a longer arcuate length than the bracket 102 such that the ends 124, 126 extend beyond the ends 116, 118 of the base 106. The clip 104 also has a track guide member 128 and a light attachment 130 that is disposed within an interior of the arcuately-shaped guide member 128. As illustrated, the guide member 128 and the light attachment 130 are formed as a single piece, although the guide member 128 and the light attachment 130 can be formed as separate pieces that are connected or attached to each other. In the illustrated construction, the guide member 128 is substantially rectangularly shaped in cross-section, although the shape will generally match the shape of the track 114.

The guide member 128 extends between the first and second ends 124, 126 and has a curved outer surface 134 that is mateable with the recessed surface 121. While the illustrated outer surface 134 has a substantially smooth surface contour, non-smooth contours are possible and considered herein. The guide member 128 also has first and second laterally-disposed tapered edges 136*a*, 136*b*. The first tapered edge 136*a* is mateable with the first groove 123*a* and the second tapered edge 136*b* is mateable with the second recessed groove 123*b*, as described in detail below. While the illustrated guide member 128 has the tapered edges 136*a*, 136*b* to secure the clip 104 within grooves 123*a*, 123*b*, other suitable ways of coupling the guide member 128 within the track 114 may be implemented to enable the clip 104 to rotate relative to the bracket 102.

Figures 4A, 4B, 4C, 4D:
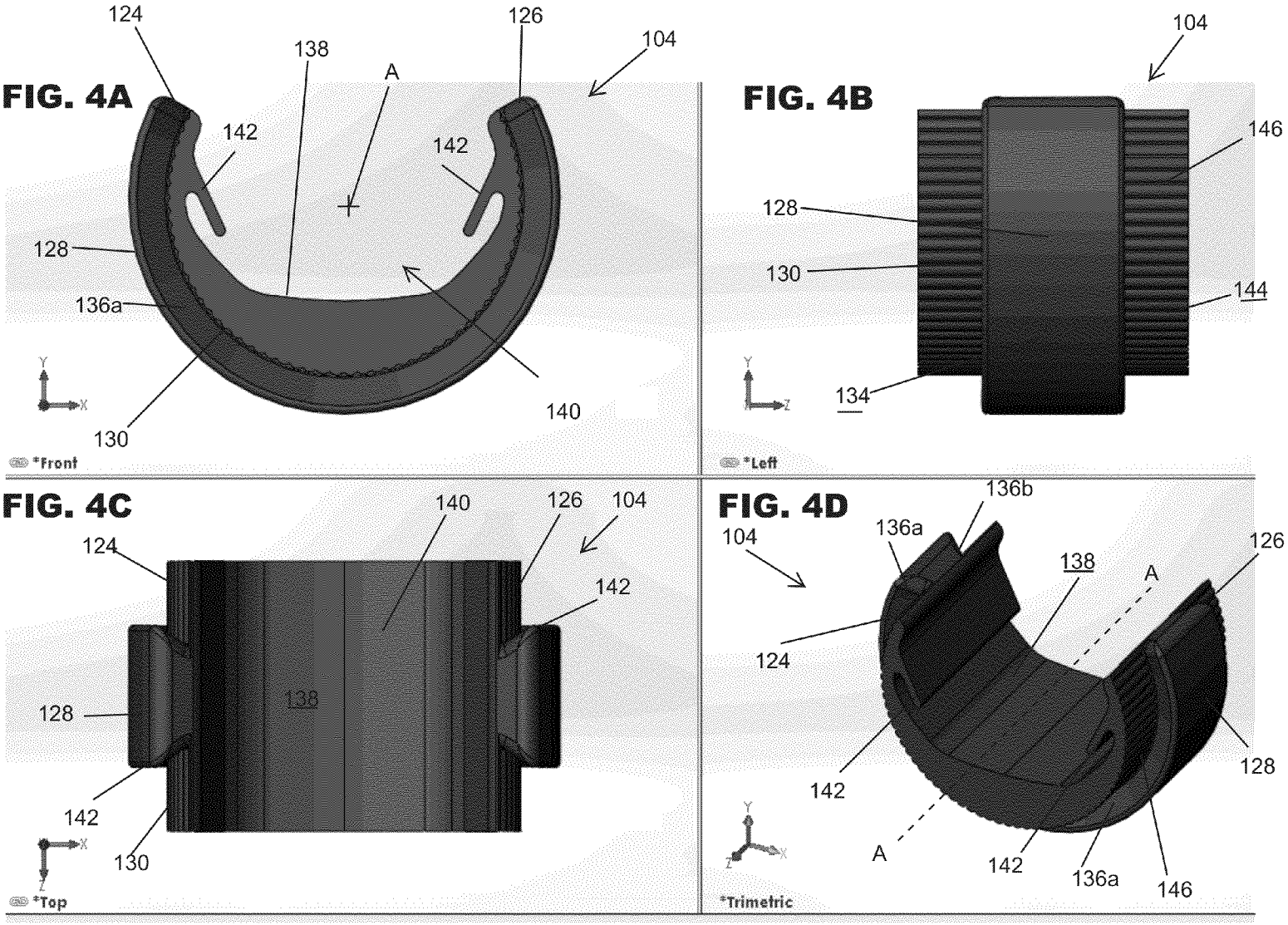
FIG. 4A illustrates a front view of the clip of FIGS. 2A-2D.
FIG. 4B illustrates a side view of the clip of FIGS. 2A-2D.
FIG. 4C illustrates a top view of the clip of FIGS. 2A-2D.
FIG. 4D illustrates a perspective view of the clip of FIGS. 2A-2D.

The light attachment 130 extends along the axis A beyond the lateral edges 136*a*, 136*b* of the guide member 128 and has an arcuate interior surface 138 that defines an elongated channel 140 to support the light source 101. As shown in FIGS. 4A, 4C, and 4D, projections 142 extend outward and generally downward (as viewed in FIGS. 4A and 4D) from the interior surface 138. The projections 142 are engageable with engagement portions (e.g., tabs—not shown) of the light source 101 to removably secure the light source 101 to the clip 104 in a snap-fit arrangement. In other constructions, the light source 101 can be attached to the dip 104 by other attachment mechanisms.

With reference to FIGS. 4B-4D, the light attachment 130 also has exterior surfaces 144 that define plurality of closely spaced second ridges or ribs or serrations 146 that are engageable with the first serrations 120. As illustrated, the second serrations 146 extend along the entire exterior surfaces 144 between the first and second ends 124, 126. That is, the second serrations 146 extend laterally outward on either side of the guide member 128. As illustrated, the second serrations extend laterally outward on both sides of the guide member 128. In other constructions, the second serrations 146 can be disposed along portions of the exterior surfaces 144.

The guide member 128 is sized and shaped to engage the track 111 from adjacent ends 116, 118 of the base 106. With the guide member 128 engaged with the track 114, the clip 104 and the light 100 can rotate relative to the bracket 102 about the axis A. With reference to FIGS. 2A-4D, the light fixture 100 is assembled by rotatably attaching the clip 104 to the bracket 102. To accomplish this, the guide member 128 is aligned with and inserted into the track 114 so that the tapered edges 136*a*, 136*b* engage the recessed grooves 123*a*, 123*b* and the outer surface 144 is slidably engaged with the recessed surface 121. The guide member 128 can slide along the recessed surface 121 of the track 114. Upon engagement of the bracket 102 and the clip 104, the first and second serrations 120, 146 are meshed together to resist rotational movement of the clip 104 (and the light source 101) relative to the bracket 102. That is, the first and second serrations 120, 146 define mating surfaces that cooperatively define a frictional interference between the bracket 102 and the clip 104. As illustrated, the clip 104 can rotate approximately 180° about the axis A when a force is applied to the first end 124 or the second end 126 of the clip 104.

As described above, fasteners are inserted into the apertures 110 to secure the light fixture 100 to the case or another structure. The light source 101 can be coupled to the light fixture 100 before or after the mounting bracket 102 is attached to the desired structure. To attach and retain the light source 101 in the clip 104, the light source 101 is placed within the channel 140 so that the attachment mechanism of the light source 101 engages the projections 142 (e.g., in a snap-fit arrangement). the With the light source 101 secured to the light fixture 100, the clip 104 can be rotated to achieve a desired orientation for the light source 101 by applying pressure adjacent the first end 124 or the second end 126 depending on the desired direction of orientation. In some constructions, the light source 101 can be engaged with the clip 104 in such a manner that the light source 101 presses on or flexes the ends 124, 126 of the clip 104. Flexing the ends 124, 126 increases the frictional interference between the bracket 102 and the clip 104 to provide a higher resistance to rotation of the clip 104 relative to the base 106.

The position of the clip 104 relative to the bracket 102, and therefore the light source 101 relative to the product display area, is held via the resistance generated by the tooth-like mating interface between the first and second serrations 120,

146. The resistance generated by the first and second serrations 120, 146 is strong enough to inhibit inadvertent movement of the clip 104 while permitting desired movement. Also, due to the engagement of the light source 101 by the projections 142, the light source 101 can be removed and replaced by another light assembly. Additionally, it should also be understood that the clip 104 could be constructed to receive different sizes and shapes of LEDs.

Various features and advantages of the invention are set forth in the following claim.

The invention claimed is:

1. A light fixture assembly comprising:

a bracket defined by an arcuate base; and a clip dovetailed to the bracket within the base, wherein the clip and the bracket define cooperative serrations to permit rotatable adjustment of the clip relative to the base about a longitudinal axis to provide different orientations for a light source within the case.

2. The light fixture assembly of claim 1, wherein the serrations on the bracket are defined approximately midway between arcuate ends of the arcuate base.

3. The light fixture assembly of claim 2, wherein the clip includes a guide member coupled to an arcuate channel defined by the bracket, and wherein the serrations on the clip extend laterally outward on either side of the guide member.

4. The light fixture assembly of claim 1, wherein the guide member is insertable into the channel adjacent ends of the arcuate base.

5. The light fixture assembly of claim 1, wherein the clip defines an interior space and includes a projection extending inward into the interior space.

6. The light fixture assembly of claim 5, wherein the arcuate base is defined by a truncated arcuate-shaped body and the clip is defined by a truncated arcuate-shaped body nested in the base.

7. The light fixture assembly of claim 5, further comprising a light source coupled to the clip in a snap-fit arrangement via the projection, and wherein the light source is engaged with and flexes at least a portion of the clip to increase friction between the clip and the bracket.

8. The light fixture assembly of claim 7, wherein ends of the clip extend beyond ends of the arcuate base, and wherein the light source flexes the ends of the clip.

9. The light fixture assembly of claim 1, wherein the serrations are formed on mating surfaces of the bracket and the clip and define a frictional interference between the bracket and the clip.

10. A light fixture comprising:

a bracket including a truncated arcuate-shaped base having an arcuate channel disposed in an inner arcuate surface of the base and extending from one end of the base to another end of the base; and a clip shaped to couple a light source to the light fixture and including a guide member coupled to the bracket within the channel, the clip rotatable relative to the bracket within the channel to arcuately adjust the light source to provide different orientations for the light source.

11. The light fixture of claim 10, wherein the channel is accessible by the guide member from the ends of the base.

12. The light fixture of claim 10, wherein the base includes first serrations disposed on the inner arcuate surface, and wherein the clip includes second serrations extending laterally outward on either side of the guide member and engageable with the first serrations to resist rotation of the clip.

13. The light fixture of 12, wherein the fist serrations are defined midway between the ends of the base.

14. The light fixture of claim 9, wherein the clip is defined by an arcuate-shaped body that is engaged with the arcuate-shaped base and rotatable approximately 180° relative to the bracket.

15. A merchandiser comprising:

a case defining a product display area and including at least one of a canopy disposed over the product display area and a shelf positioned in the product display area; and a light fixture coupled to at least one of the canopy and the shelf, the light fixture including a bracket defined by an arcuate base and a clip dovetailed to the bracket within the base, wherein the clip and the bracket define cooperative serrations to permit rotatable adjustment of the clip relative to the base about a longitudinal axis defined by the arcuate base to provide different orientations for a light source within the case.

16. The merchandiser of claim 15, wherein the serrations on the bracket are defined approximately midway between arcuate ends of the arcuate base.

17. The merchandiser of claim 16, wherein the clip includes a guide member coupled to an arcuate channel defined by the bracket, and wherein the serrations on the clip extend laterally outward on either side of the guide member.

18. The merchandiser of claim 15, wherein the clip is defined by an arcuate body engaged with the bracket and having an interior space, and wherein the clip includes a projection extending inward into the interior space.

19. The merchandiser of claim 18, further comprising a light source coupled to the clip within the interior space in a snap-fit arrangement via the projection, and wherein the light source is engaged with and flexes at least a portion of the clip adjacent ends of the clip to increase friction between the clip and the base.

20. The merchandiser of claim 18, wherein ends of the clip extend beyond ends of the arcuate base.

* * * * *